US005988983A

United States Patent [19]

Furusawa

[11] Patent Number: 5,988,983

[45] Date of Patent: Nov. 23, 1999

[54] INFUSION METHOD AND INFUSION PUMP

[75] Inventor: Kouichi Furusawa, Fujinomiya, Japan

[73] Assignee: Terumo Kabushiki Kaisha, Tokyo, Japan

[21] Appl. No.: 08/861,567

[22] Filed: May 22, 1997

[51] Int. Cl.[6] ..... F04B 49/00

[52] U.S. Cl. ..... 417/43; 417/53; 417/478

[58] Field of Search ..... 417/474, 478, 417/53, 43

[56] References Cited

U.S. PATENT DOCUMENTS

| | | | |
|---|---|---|---|
| 3,990,444 | 11/1976 | Vial | 604/67 |
| 4,781,548 | 11/1988 | Alderson et al. | 417/478 |
| 5,018,945 | 5/1991 | D'Silva . | |
| 5,055,013 | 10/1991 | Faeser | 417/474 |
| 5,151,019 | 9/1992 | Danby et al. | 417/478 |
| 5,165,873 | 11/1992 | Meijer | 417/474 |
| 5,716,194 | 2/1998 | Butterfield et al. | 417/43 |

FOREIGN PATENT DOCUMENTS

| | | |
|---|---|---|
| 0 426 273 | 5/1991 | European Pat. Off. . |
| 0 560 270 | 9/1993 | European Pat. Off. . |
| 0 426 273 | 10/1994 | European Pat. Off. . |
| 2 475 645 | 8/1981 | France . |
| 2 553 151 | 4/1985 | France . |
| 2 020 735 | 11/1979 | United Kingdom . |

*Primary Examiner*—Charles G. Freay
*Attorney, Agent, or Firm*—Burns, Doane, Swecker & Mathis, LLP

[57] ABSTRACT

According to an infusion method and pump, in order to perform infusion at a flow rate with high accuracy by allowing finger members to appropriately press a predetermined portion of an outer diameter (outer surface) of an infusion tube whose outer diameter accuracy is assured, thereby causing the infusion tube to perform a peristaltic motion, the infusion tube is stationarily held between a plurality of fingers which are arranged along the longitudinal direction of the infusion tube having a predetermined outer diameter and independently driven, and a holding means. The infusion tube is pressed from the outer surface to supply a liquid by setting a small moving amount of each finger to a degree enough to eliminate the influence of the wall thickness of the infusion tube and individually driving the fingers.

17 Claims, 9 Drawing Sheets

EXAMPLE OF ACTUAL MEASUREMENT OF COLLAPSE AMOUNT OF TUBE AND DISCHARGE AMOUNT $$\Delta A = \pi d^2 - \pi ( d - \Delta d )^2 = \pi \Delta d ( 2d - \Delta d )$$
$$\Delta V = \Delta S \cdot L = \pi \Delta d ( 2d - \Delta d ) \cdot L$$

INFUSION METHOD AND INFUSION PUMP

BACKGROUND OF THE INVENTION

The present invention relates to an infusion pump and, more particularly, to a peristaltic infusion pump for performing to infuse liquid medicine or the like by pressing the outer surface of a flexible infusion tube.

To deliver the contents or liquid filled in the infusion tube, a peristaltic infusion pump having finger members operating in the longitudinal direction of the infusion tube is used.

According to a "pumping apparatus" in European Patent No. 0426273, the following infusion technique is disclosed. Closing means for closing an infusion tube are disposed on the upstream and downstream sides of the infusion tube, and a pair of finger members integrally formed by a plurality of fingers are disposed between the closing means. After the shape portions formed in the finger members hold the infusion tube, the finger members are reciprocated to press the outer surface of the infusion tube at the shape portions to almost completely collapse the infusion tube, thereby reducing the sectional area of the infusion tube.

SUMMARY OF THE INVENTION

In a peristaltic infusion pump having a plurality of finger members which can be independently driven, infusion is so performed as to almost collapse an infusion tube.

With this arrangement, a discharge amount changes depending on the difference in sectional area due to the difference between the inner diameters of infusion tubes, which difference results from the manufacturing conditions of infusion tubes.

This will be described with reference to FIG. 9. Assume that the inner diameter of a cylindrical infusion tube T before collapse and a difference in inner diameter between the tubes are defined as 2d and 2Δd, respectively. In this case, a discharge amount error ΔV represented by $\pi\Delta d(2d-\Delta d)L$, which is a discharge amount difference per period (cycle) of a finger obtained by the difference (ΔA) in sectional area difference (2Δd) due to manufacturing conditions or the like in inner diameter between the tubes.

It is possible to manufacture infusion tubes almost free from inner diameter errors. These tubes, however, are more expensive than infusion tubes almost free from outer diameter errors in terms of manufacturing management and the like. Infusion tubes are often repeatedly used in actual medical services. New infusion tubes which are frequently used are often nonuniform in inner diameter and have errors in inner diameters. As a result, errors occur in discharge amounts.

The present invention has been made in consideration of the conventional problems described above, and has as its object to provide an infusion method and pump capable of performing infusion at a flow rate with high-accuracy by allowing finger members to appropriately press the predetermined portion of the outer diameter (outer surface) of an infusion tube whose dimensional precision is assured in outer diameter due to a reason such as manufacturing management for assuring the accuracy of the outer diameter easier than the accuracy of the inner diameter.

In order to solve the above problems and achieve the above object, according to the present invention, there are provided an infusion method and pump for pressing an outer surface of an infusion tube to supply a liquid, wherein the infusion pump comprises a plurality of fingers which are arranged along a longitudinal direction of the infusion tube having a predetermined outer diameter and independently driven, and holding means for stationarily holding the infusion tube between the fingers, and the infusion tube is pressed from the outer surface to supply the liquid by setting a small moving amount of each finger and individually driving the fingers, thereby eliminating the influence of the wall thickness of the infusion tube.

In the infusion method and pump, the fingers are defined as first, second, . . . , Nth fingers from an upstream side of a liquid flow, the first to (N−1)th fingers are sequentially and individually driven from a bottom dead center to top dead centers, the first to (N−1)th fingers are set to simultaneously move toward the bottom dead center when the first to (N−1)th fingers are phase-locked, the Nth finger is set to be individually driven from the bottom dead center to a top dead center next to the (N−1)th finger and move toward the bottom dead center when the first finger reaches the top dead center, the first and Nth fingers are individually driven to perfectly close the infusion tube at the top dead center, and the second to (N−1)th fingers are individually driven not to close an inner cavity of the infusion tube at the top dead center.

A clamping width between the holding means and the bottom dead center of the first to Nth fingers is set smaller than the outer diameter of the infusion tube.

One or a plurality of external fingers are disposed downstream the Nth finger to suppress pulsation caused by individual driving of the fingers, the external fingers are individually driven from a top dead center to a bottom dead center at a phase for moving the first to Nth fingers toward the top dead center, the external fingers are individually driven from the bottom dead center to the top dead center at a phase for individually driving the Nth finger toward the bottom dead center, and the external fingers do not close the infusion tube at the top dead center.

In order to suppress pulsation caused by individual driving of the fingers, speed for sequentially and individually driving the fingers from the bottom dead center to the top dead centers is set proportional to the reciprocal of the tube collapse amount obtained by subtracting the clamping width from the outer diameter of the infusion tube.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

Figure 1A:
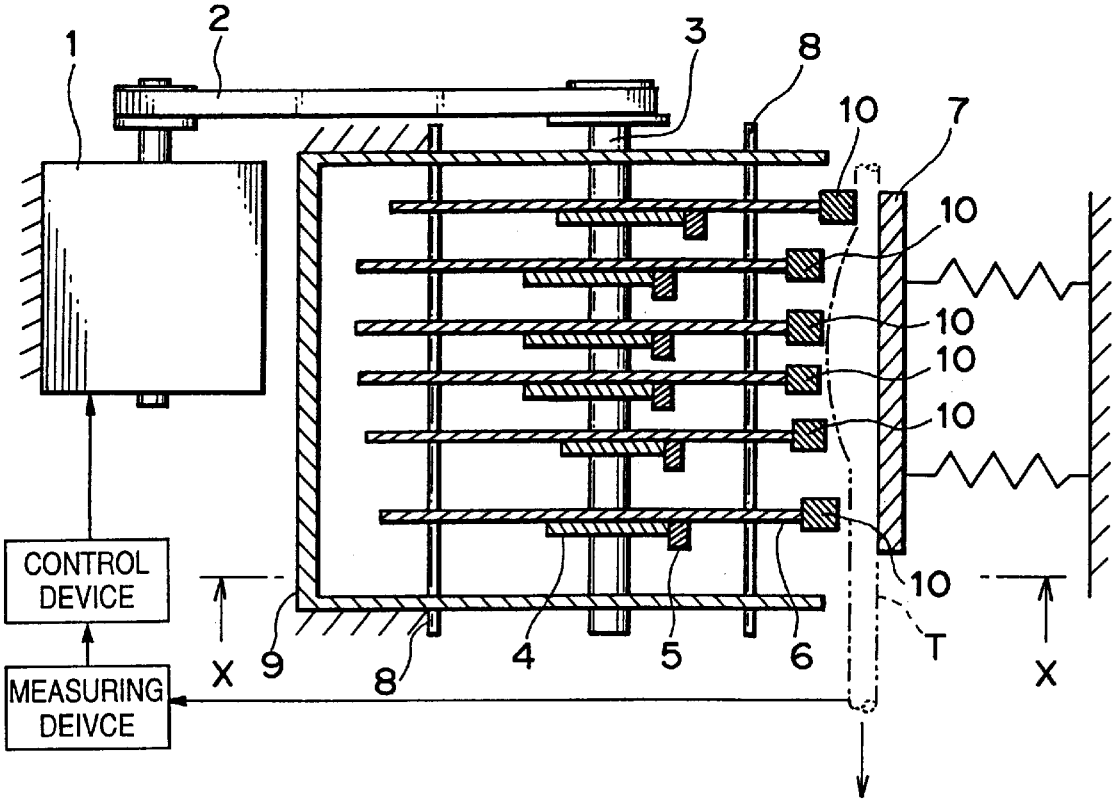
FIG. 1A is a sectional view of an infusion pump eliminating cover.

The preferred embodiment of the present invention will be described in detail below with reference to the accompanying drawings. FIG. 1A is a sectional view of an infusion pump, and FIG. 1B is a sectional view thereof along the line X—X in FIG. 1A.

Figure 1B:
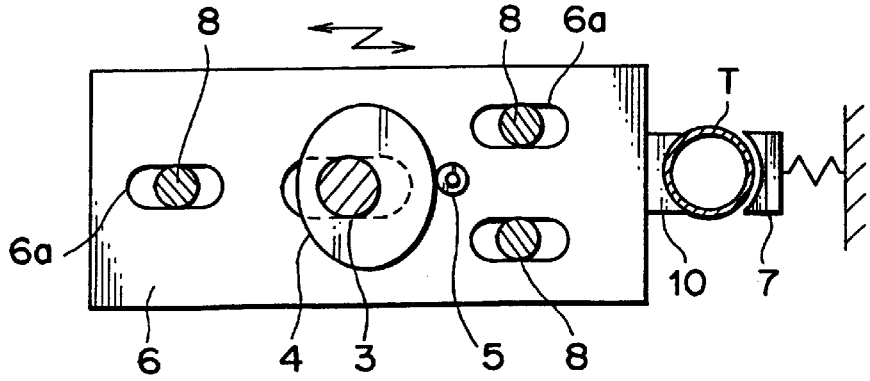
FIG. 1B is a sectional view thereof along the line X—X in FIG. 1A.

FIGS. 1A and 1B show only the driving portion of the infusion pump, and the remaining parts including cover are not illustrated.

Referring to FIGS. 1A and 1B, a driving motor 1 is fixed to a base indicated by a hatched portion. A rotation force generated upon energization is transmitted to a cam shaft 3 through a belt 2. The cam shaft 3 is rotatably supported by a case 9 fixed to the base.

As illustrated in FIG. 1A, six cams 4 are fixed to the cam shaft 3. The cams 4 are respectively brought into contact with collars 5 rotatably supported on the side surfaces of finger plates 6 each having one end fixed to a corresponding one of the fingers 10, so that the rotating motion of each cam 4 is converted into the linear motion of the corresponding finger plate 6.

Each finger plate 6 keeps clamping an infusion tube T (not shown, but indicated by the broken line) with a reception plate 7 locked to an openable door (not shown) through springs. Thereafter, the driving motor 1 is driven to reciprocate the finger plates 6 in directions indicated by the double-headed arrow in FIG. 1B. The infusion tube T clamped between the finger plates 6 and the reception plate 7 is sequentially closed by the fingers 10 in a manner to be described later, thereby supplying the liquid contained in the infusion tube T.

Each cam plate 6 is so supported as to extend through shafts 8 through elliptic guide holes 6*a* of the corresponding finger plate 6, as shown in FIG. 1B, thereby eliminating lateral backlash. The infusion tube T is always and stably collapsed almost vertically in the directions indicated by the double-headed arrow. Since the plurality of shafts 8 parallel to the shaft 3 which rotatably supports the corresponding cam 4 are disposed and extend through elliptic holes each having a diameter almost equal to that of the shaft mounted in the finger to suppress right-and-left backlash of the corresponding finger.

There are various engaging relationships between the cams 4 and the collars 5, and only an example is illustrated in FIGS. 1A and 1B. The engaging relationship and the cam drive mechanism arrangement are not limited to those shown in FIGS. 1A and 1B. For example, various mechanisms ranging from a groove-cam system to a mechanism using a collar and a link can be employed, as a matter of course. Alternatively, each collar rotatably mounted on a shaft so as to move a corresponding finger back and forth in accordance with a free cam curve may be brought into contact with the cam, and the corresponding finger may move back and forth in accordance with the shape of the cam.

Although not shown, an infusion tube having a drip infusion cylinder (member) connected to the outlet of an infusion bag is often used by being clamped by the fingers.

Referring to FIGS. 1A and 1B, in order to allow the finger 10 at the lowermost cam plate 6 to prevent pulsation, this finger 10 is driven to the position of the top dead center (right side in FIGS. 1A and 1B) to collapse the infusion tube while the liquid drug is flowing in the infusion tube T. For this reason, in order to continue supplying the liquid drug downstream even in the state of the top dead center position, the lowermost finger 10 gradually moves from the top dead center to the bottom dead center during the discharge operations of the upper fingers. Therefore, part of the liquid drug discharged from the upper fingers 10 can be stored at the tube portion with which the lowermost finger 10 is in contact.

To the contrary, during the in-flow (infusion) of the liquid drug by the motion of upper fingers 10, the finger 10 at the lowermost cam plate 6 moves from the bottom dead center to the top dead center. The cam surface timings are so set as to correct the supply of the liquid drug and continue the supply.

Note that one finger 10 is disposed at each cam plate 6 in FIGS. 1A and 1B. However, a plurality of fingers 10 may be disposed at each cam plate. If a finger has a large thickness, only one finger may be used. The plurality of fingers may have different thicknesses. As described above, the shape and number of fingers can be arbitrarily selected. In short, the number and shape of the upper fingers 10 are set in accordance with a discharge amount determined by one revolution of the cam shaft 3.

According to the infusion pump having the above structure, fingers except the uppermost finger 10 and the lowermost finger 10 are designed not to completely collapse the infusion tube T.

The principle of operation will be described with reference to the view (FIG. 2) showing a change in sectional area when a thick tube is collapsed.

Figure 2:
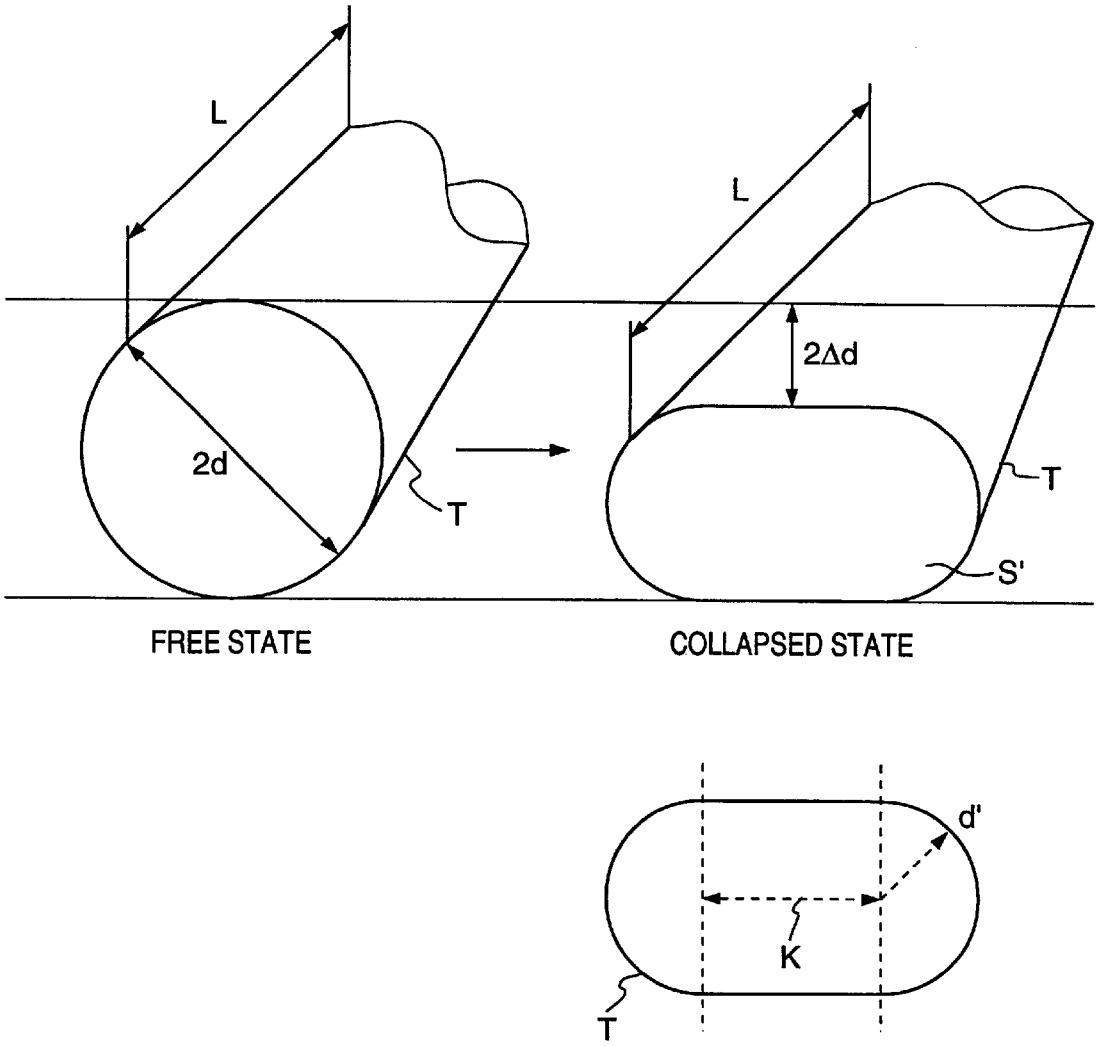
FIG. 2 is a view illustrating a sectional state of the infusion tube.

Referring to FIG. 2, the infusion tube T is made of a flexible material consisting of a thermoplastic resin such as polyvinyl chloride resin almost free from permanent deformation by elongation upon collapse. The peripheral length of the infusion tube T will not change even when fingers press the tube.

The inner diameter of the infusion tube T in a free state before collapse is defined as 2d, and an L portion of the tube in the longitudinal direction is collapsed by the fingers.

Assume that the infusion tube T is collapsed by 2Δd to obtain an ellipse having semicircular portions each having a radius d', as indicated by the broken line. In this case, when the straight portion of the ellipse is defined as K, as illustrated in FIG. 2, a peripheral length 2πd does not change, so that the following equations are established:

$$2\pi d = 2K + 2\pi d' \quad (1)$$

$$d' = d - \Delta d \quad (2)$$

Equations (1) and (2) derive the following equation:

$$K = \pi \Delta d \quad (3)$$

An inner area S' obtained by collapsing the infusion tube T by 2Δd is given as follows:

$$S' = 2d'K + \pi d'^2 = \pi(d^2 - \Delta d^2) \quad (4)$$

Since the initial area was $\pi d^2$, a decrease ΔS in area upon collapsing the infusion tube T by the fingers by 2Δd is given by:

$$\Delta S = \pi \Delta d^2 \quad (5)$$

As can be apparent from equation (5), the discharge amount upon collapsing the infusion tube T is proportional to the square of a collapse amount Δd. This indicates that the flow rate can be accurately controlled even in use of infusion tubes T having different outer diameters due to manufacturing conditions or the like if the collapse amount is measured and controlled with high accuracy.

Figure 3:
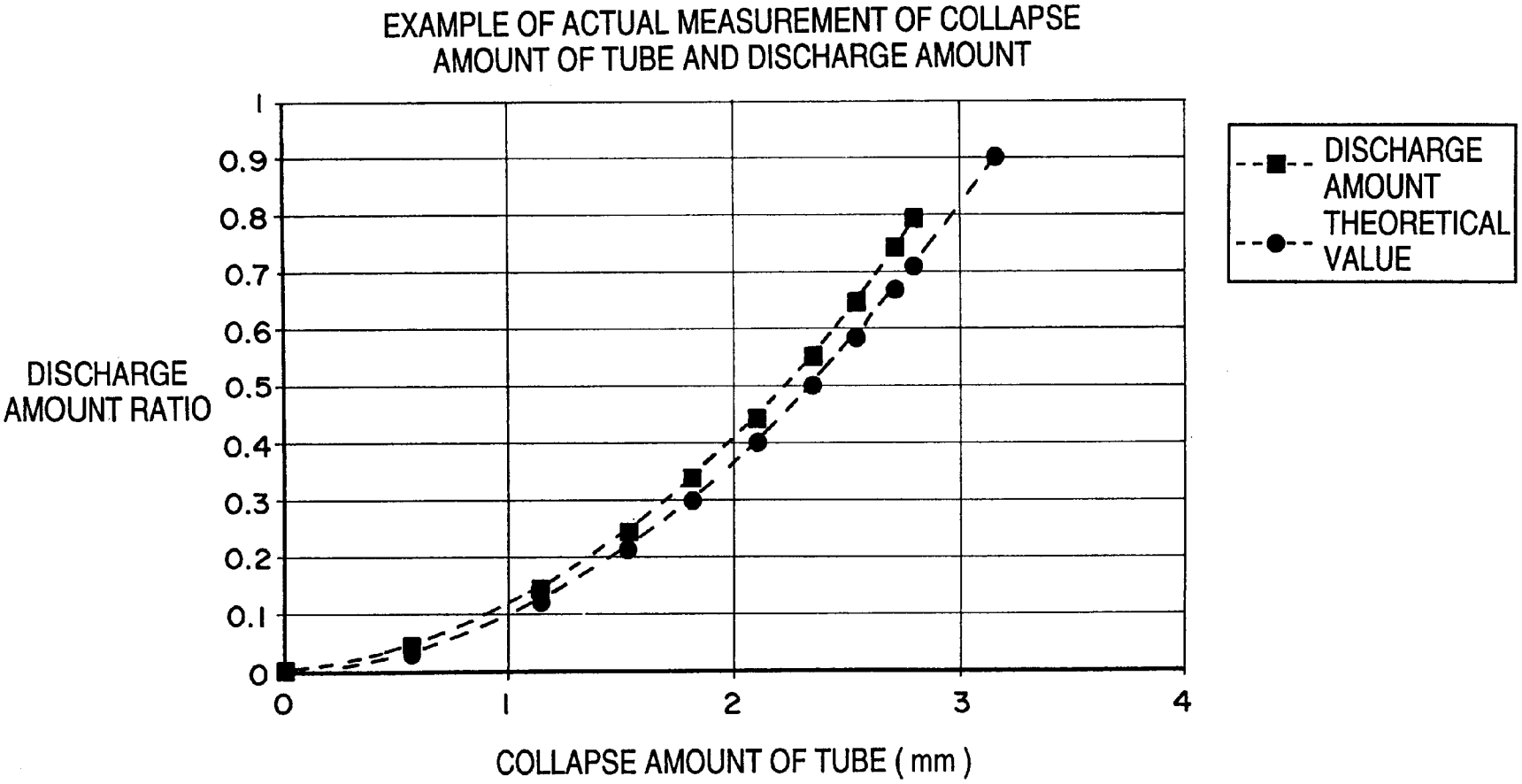
FIG. 3 is a graph showing the relationship between the discharge amount and the collapse amount obtained when the infusion tube is collapsed.

The relationships between the collapse and discharge amounts of infusion tubes were actually checked in an experiment. The graph shown in FIG. 3 representing the relationships between the actually measured collapse and discharge amounts of infusion tubes was obtained. Curves obtained by this experiment were parabolic, and it was confirmed that the measured values almost agreed with the calculated values in equation (5).

Actual infusion tubes T have wall thicknesses, and tolerances which vary depending on the manufacturing conditions must be added to the thickness even if these infusion tubes are formed in the same manufacturing method. According to the conventional driving scheme for perfectly collapsing an infusion tube up to zero inner diameter, the relationship between the discharge amount and the collapse amount of the outer diameter of the tube necessarily includes an error corresponding to the wall thickness tolerance. In other words, the inner tube area error caused by the manufacturing tolerance of the inner diameter of the tube directly results in a discharge amount error.

Even at the top dead center to which each finger moves maximum, when the clamping width is so set not to make the inner diameter zero in consideration of the tolerance of the wall thickness, a change in discharge amount depends on only the tolerance of the outer diameter. The manufacturing tolerance of the outer diameter of the infusion tube T can be controlled easier than that of the inner diameter, and at the same time, measurement can be facilitated, thereby allowing manufacturing management.

When the clamping width between the finger 10 and the receiving plate (receiving member) 7 FIGS. 1A and 1B is set larger than the outer diameter at the bottom dead center and larger than the wall thickness of the infusion tube T at the top dead center, the flow rate can be managed with high accuracy even in use of a general inexpensive infusion tube. Such a general-purpose infusion tube greatly varies in outer diameter. For this reason, an outer diameter measurement sensor or outer diameter measuring apparatus (means) can be arranged in an infusion pump to automatically measure the outer diameter of an infusion tube set in a driving portion, calculate a change in discharge amount, and control the driving motor speed or motor rotation rate in accordance with the change in discharge amount. Even if various types of infusion tubes are used, the flow rates can be controlled with high accuracy.

Figure 4:
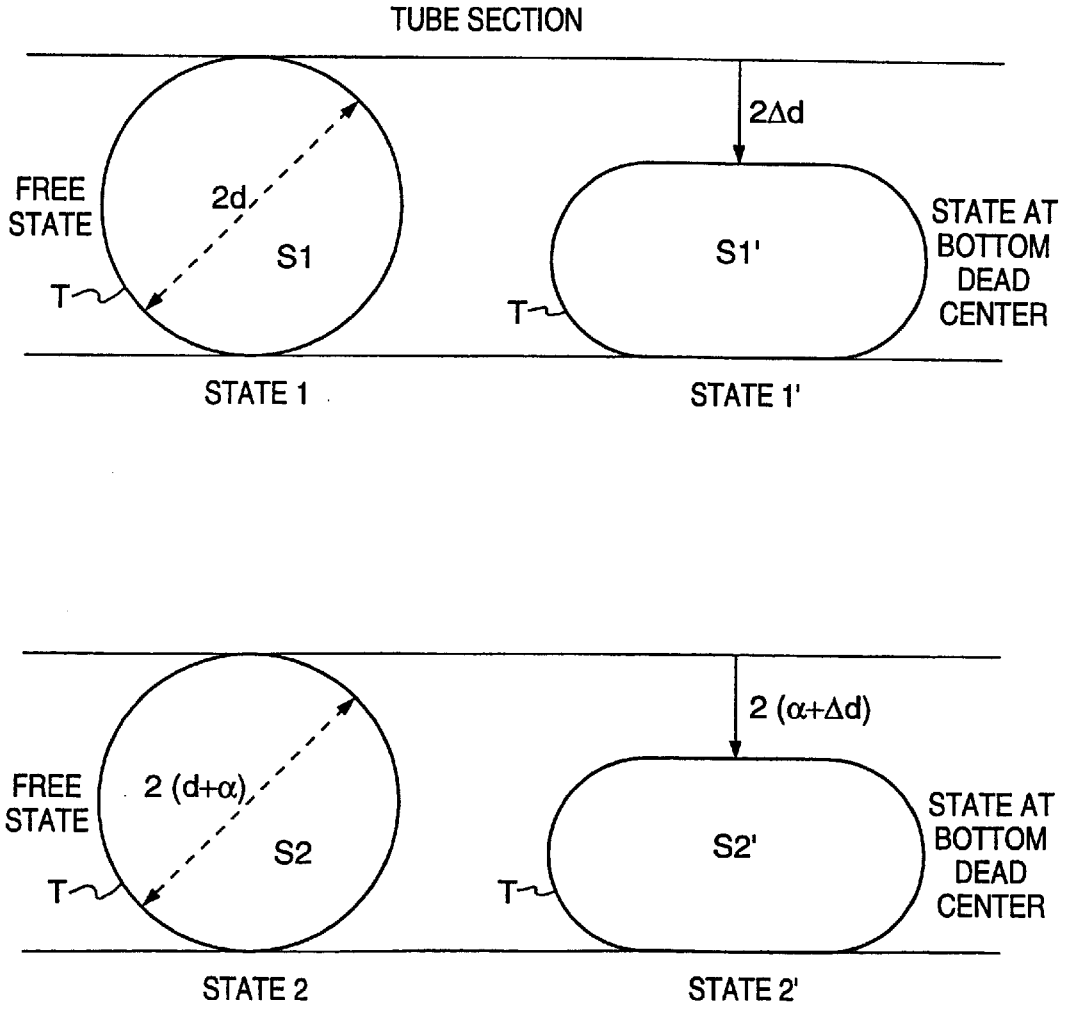
FIG. 4 is a view illustrating a sectional state of the infusion tube.

FIG. 4 is a view illustrating that an infusion amount error can be corrected in an infusion tube having an outer diameter tolerance including an outer diameter tolerance 2α. FIG. 4 shows that the infusion amount error caused by the outer diameter tolerance can be corrected such that the clamping width between the receiving plate and the finger when the finger reaches the bottom dead center is set smaller than the outer diameter of the infusion tube.

Referring to FIG. 4, when an infusion tube T having an inner diameter 2d without considering the wall thickness, and an infusion tube having an inner diameter 2(d+α) considering the diameter tolerance of 2αare set in the driving portions, the clamping widths are set to 2(d−Δd) at the bottom dead center. 2Δd is the collapse amount. Note that the inner diameter portion of the tube is substantially perfectly collapsed at the top dead center.

The sectional areas in the respective states in FIG. 4 are represented by equations (6) to (9):

$$S1=\pi d^2 \quad \text{(6) State 1}$$

$$S2=\pi(d+\alpha)^2 \quad \text{(7) State 2}$$

$$S1'=\pi(d^2-\Delta d^2) \quad \text{(8) State 1'}$$

$$S2'=\pi(d+\alpha)^2-\pi(\alpha+\Delta d)^2 \quad \text{(9) State 2'}$$

The sectional areas of the two infusion tubes which are set free at the bottom dead center are obtained by equations (6) and (7). A ratio of the sectional areas when perfectly collapsing the tubes from the free state corresponding to the top dead center is given by equation (10). Similarly, the sectional areas of the two infusion tubes which are collapsed at the bottom dead center are given by equations (8) and (9). When a ratio of the sectional areas when collapsing the tubes from 10 the states obtained by equations (8) and (9) is given by equation (11):

$$\frac{S2}{S1}=\frac{\pi(d+\alpha)^2}{\pi d^2}=\left(1+\frac{\alpha}{d}\right)^2\cong 1+2\frac{\alpha}{d}(d\gg\alpha) \quad (10)$$

$$\begin{aligned}\frac{S2'}{S1'}&=\frac{\pi(d+\alpha)^2-\pi(\alpha+\Delta d)^2}{\pi(d^2-\Delta d^2)}\\&=\frac{d+\Delta d+2\alpha}{d+\Delta d}=1+2\frac{\alpha}{d+\Delta d}\\&=1+2\frac{\alpha}{d\left(1+\frac{\Delta d}{d}\right)}\end{aligned} \quad (11)$$

From equation (10), 2α/d can be the flow rate error. On the other hand, the error is defined as 2α/d(1+Δd/d) in equation (11).

From 2α/d>2α/d(1+Δd/d), the error is smaller in equation (11) than in equation (10). The tube collapsed at the bottom dead center has a smaller infusion amount error than the tube collapsed at the top dead center to improve the infusion accuracy.

Figure 5:
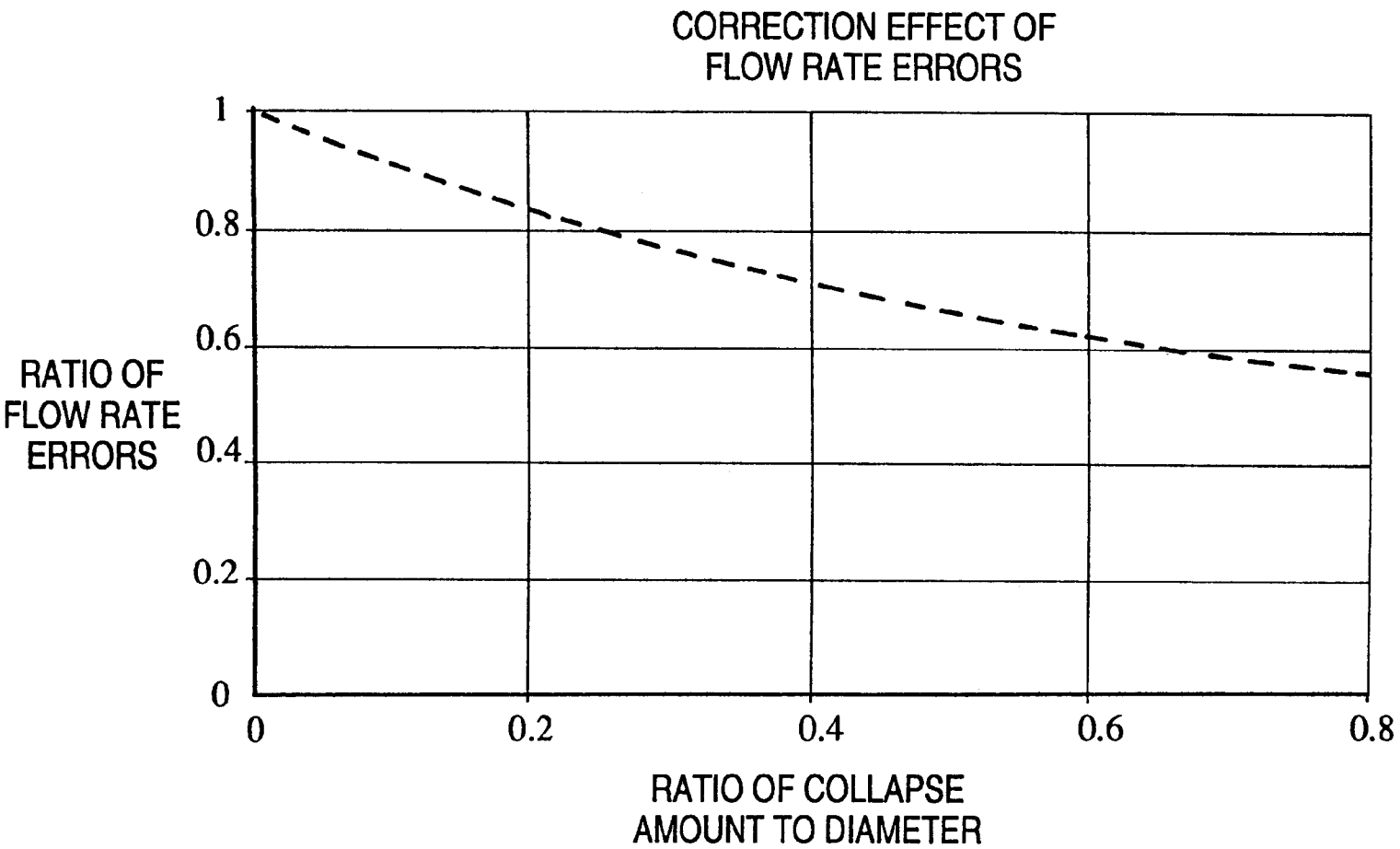
FIG. 5 is a view showing the correction effect of flow rate errors.

FIG. 5 is a graph showing the collapse amount vs. flow rate error characteristics with respect to the outer diameter of the tube, in which Δd/d is plotted along the abscissa. FIG. 5 shows an effect using, as the reference, the sectional area ratio of the two infusion tubes having diameter tolerance 2α in a free state at the bottom dead center. Referring to FIG. 5, if a ratio of the collapse amount to the outer diameter is 0.4, and an error upon perfect collapse of the tube is given as 10%, then 10%×0.7=7.0%. This indicates the improvement of infusion accuracy.

Figure 6:
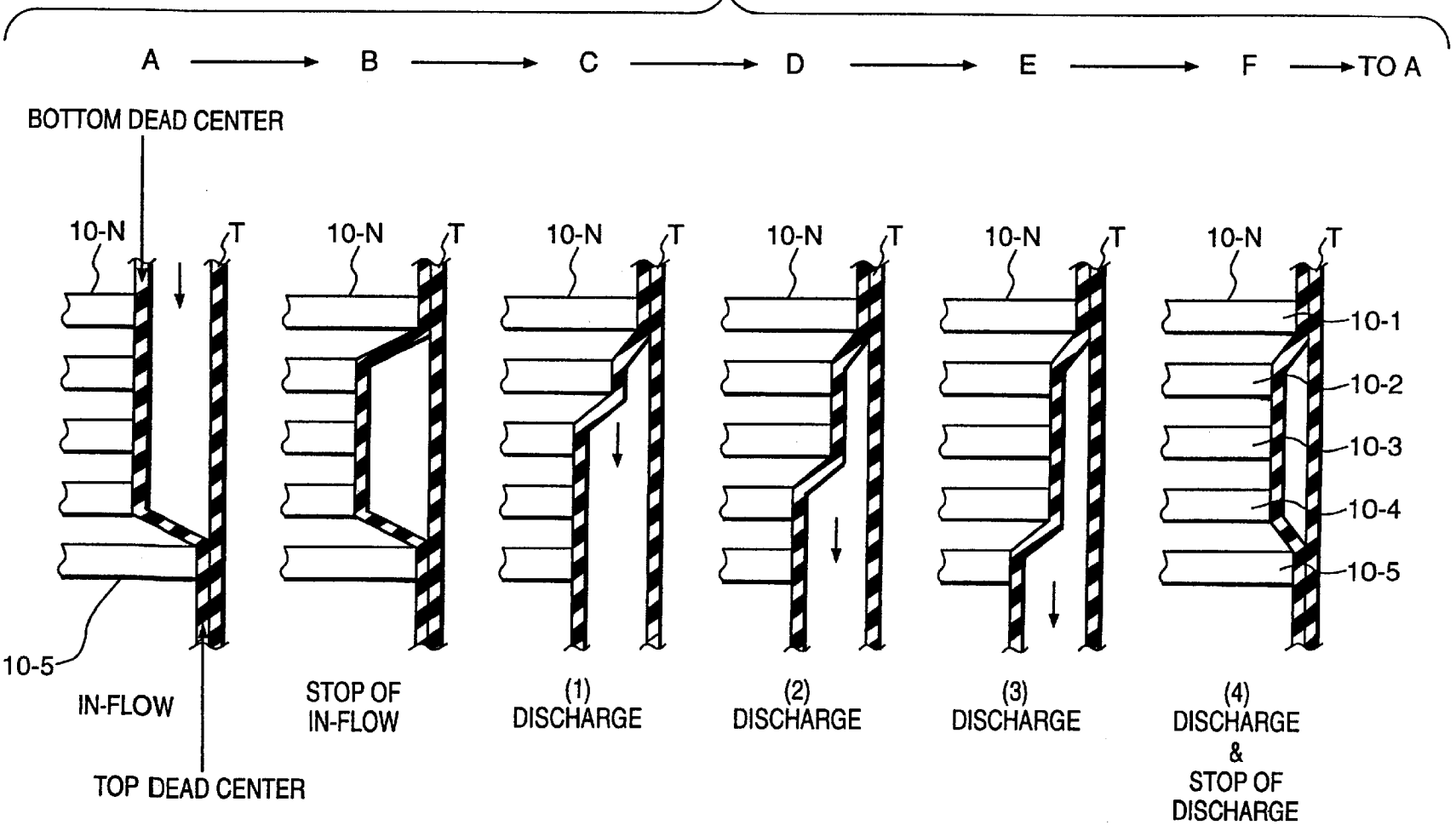
FIG. 6 is a view for explaining the operation of the fingers of the infusion pump.

The order of supplying the liquid drug will be described with reference to the view (FIG. 6) for explaining the operation to show the phases of the fingers on the basis of the principle of operation. Referring to FIG. 6, the leftmost position of each finger 10 is the bottom dead center, while the rightmost position of each finger 10 is the top dead center. The number N of fingers 10 is 5, and the five fingers are driven from step A to step F.

In step A, the lowermost fifth finger 10-5 is located at the top dead center to close the infusion tube T on the downstream side, and the remaining fingers are located at the bottom dead center. The tube clamping width at the bottom dead center is set smaller than the outer diameter of the infusion tube. In the state indicated by step A, the liquid drug flows from the upstream side and fills the infusion tube.

In step B, the uppermost first finger 10-1 moves to the top dead center to close the infusion tube to stop the flow. In step C, the fifth finger 10-5 moves toward the bottom dead center side to open the infusion tube toward the downstream side. In the process of steps D and E, the second, third, and fourth fingers 10-2, 10-3, and 10-4 sequentially move toward the top dead center side to sequentially reduce the sectional area, thereby discharging the liquid drug toward the downstream side (i.e., a direction indicated by an arrow).

Finally, in step F, the fifth finger 10-5 moves toward the top dead center side to close the infusion tube, thereby completing the discharge. The first to fourth fingers then move to the bottom dead center to complete the operation of one period. The top dead center positions of the second, third, and fourth fingers 10-2, 10-3, and 10-4 are set to clamp the infusion tube so as not to completely collapse the inner cavity of the infusion tube.

Figure 7:
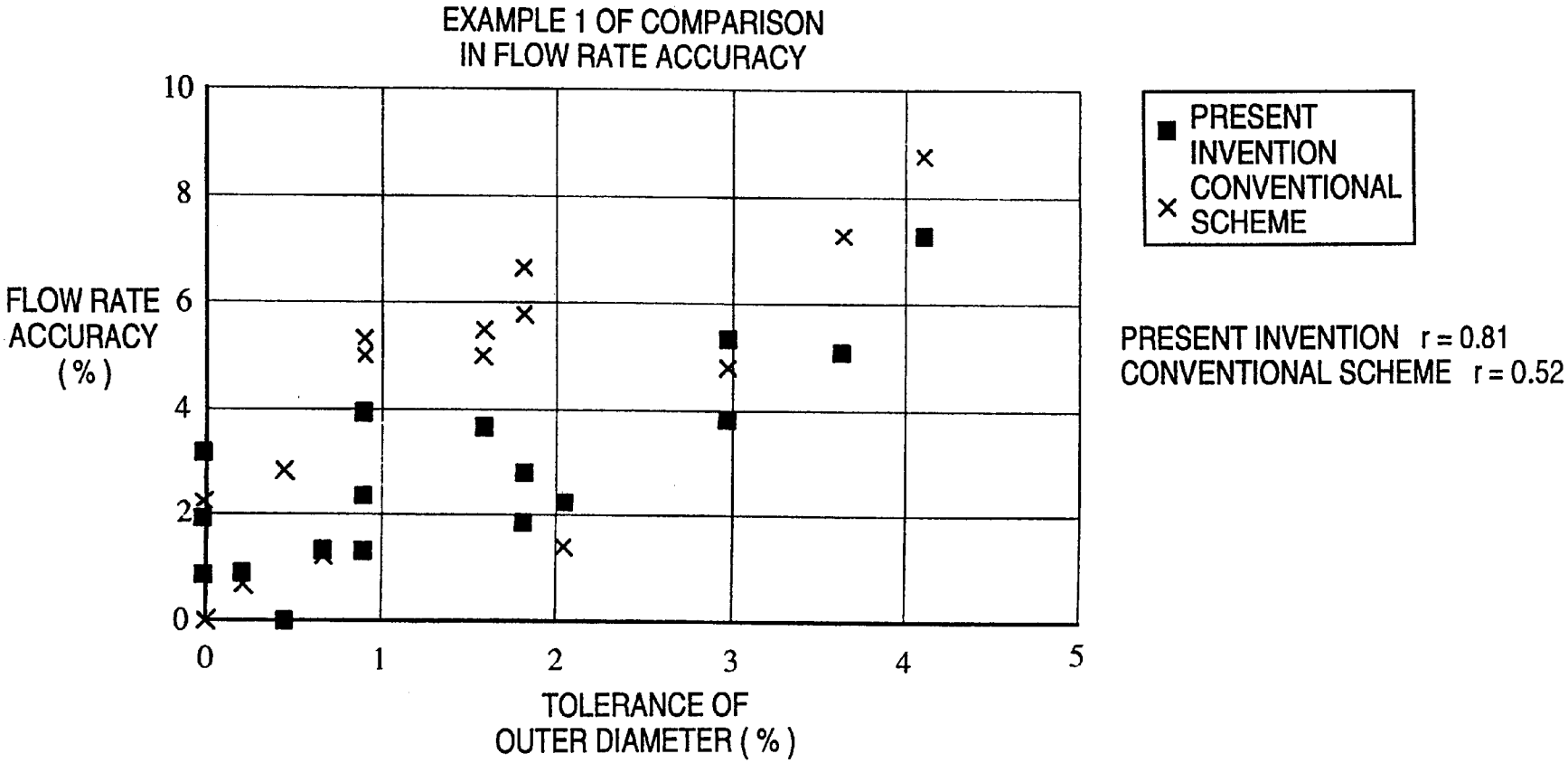
FIG. 7 is a graph showing comparison in flow rate accuracy between the present invention and the conventional method.
Figure 8:
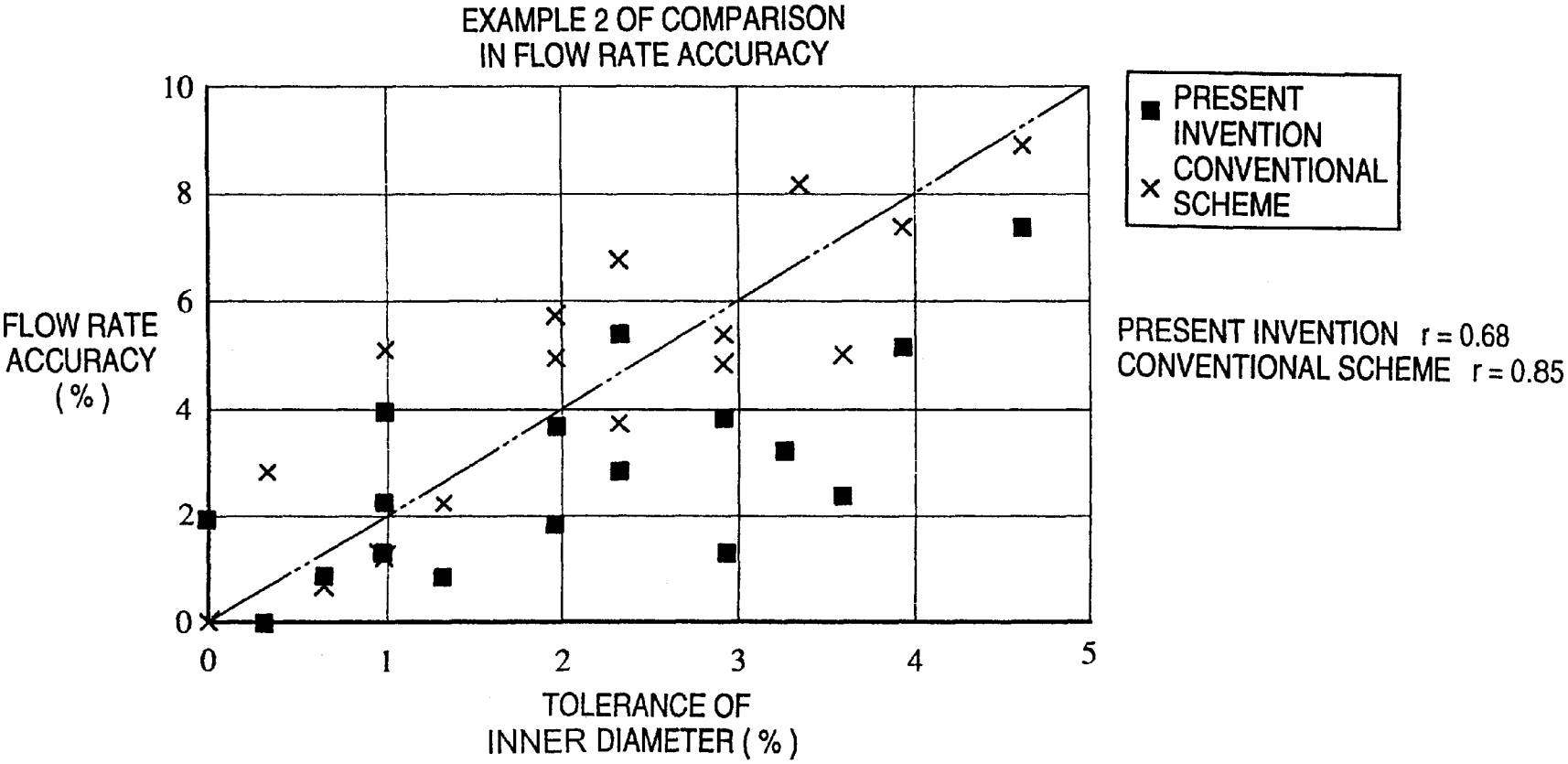
FIG. 8 is a graph showing comparison in flow rate accuracy between the present invention and the conventional method.
Figure 9:
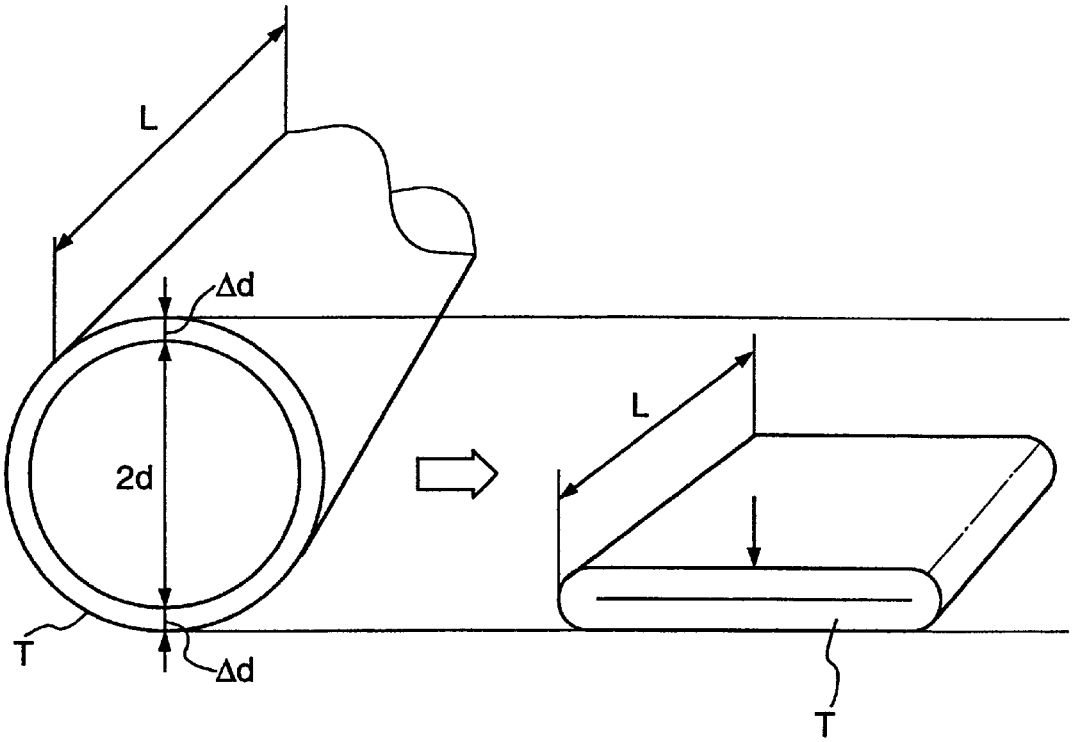
FIG. 9 is a view illustrating a sectional state of a conventional infusion tube.

The measurement comparison examples of flow rate accuracy are shown in FIGS. 7 and 8. The outer diameters of the infusion tubes are plotted along the abscissa in FIG. 7, while the inner diameters of the infusion tubes are plotted along the abscissa in FIG. 8. As can be apparent from comparison between the plotted data and between correlation coefficients r calculated on the basis of the data in FIGS. 7 and 8, the flow rate accuracy in the conventional peristaltic scheme has a strong correlation with the inner diameter, while the flow rate accuracy in the scheme of the present invention has a strong correlation with the outer diameter. At the same time, the flow rate accuracy of the present invention is higher than that of the conventional scheme.

From equation (5), the sectional area is reduced in proportion to the square of the moving amount of the finger to change the discharge amount. For this reason, when the fingers are moved from the bottom dead center to the top dead center side at a constant speed, pulsation occurs in the discharge amount during the movement. When the cam curve is so set as to make the moving speed of the finger from the bottom dead center to the top dead center proportional to a reciprocal of the moving amount of the finger, i.e., the collapse amount of the tube, the liquid drug can be supplied without any pulsation. Note that the number of fingers except the uppermost and lowermost fingers 10 need not be plural, but may be one having a predetermined thickness.

In the actual infusion pump, by referring FIG. 6, the infusion tube T has outer diameter of 4.45 mm and wall thickness of 0.65 mm, the fingers 10-2~10-N-1 have a stroke (between top dead center and bottom dead center) of 1.3 mm when not-completely collapsing the tube and a stroke of 1.7 mm when completely collapsing the infusion tube T.

That is, a ratio of completely collapsing and not completely collapsing is set as 76% when the ratio is set between 60%~85% it becomes possible to obtain the good effect as described above.

As has been described above, according to the present invention, the flow rate accuracy dependent on the outer diameter of the infusion tube can be obtained, thereby providing an infusion pump capable of obtaining stable flow rate accuracy. In addition, the loss of flexibility (degradation) of the tube can be minimized, thereby providing an infusion pump capable of obtaining stable flow rate accuracy.

As many apparently widely different embodiments of the present invention can be made without departing from the spirit and scope thereof, it is to be understood that the invention is not limited to the specific embodiments thereof except as defined in the appended claims.

What is claimed is:

1. An infusion method of pressing an infusion tube from an outer surface thereof to supply a liquid, comprising stationarily holding said infusion tube between holding means and a plurality of independently driven fingers which are arranged along a longitudinal direction of said infusion tube, said infusion tube having a predetermined outer diameter; and controlling the amount of discharge of the liquid to be proportional to the square of the amount of collapse of the infusion tube by individually driving said fingers to press said infusion tube from said outer surface to supply the liquid, each of the fingers being individually driven to move by an amount which eliminates an influence of a wall thickness of said infusion tube.

2. The method according to claim 1, wherein said fingers comprise a first, second, . . . , Nth fingers from an upstream side of liquid flow;

the method including sequentially and individually driving said first to (N−1)th fingers from a bottom dead center to a top dead center, simultaneously moving said first to (N−1)th fingers toward the bottom dead center, driving said Nth finger from the bottom dead center to a top dead center and driving said Nth finger from the top dead center toward the bottom dead center when said first finger reaches the top dead center; and said first and Nth fingers being driven to completely close said infusion tube when the first and Nth fingers are at the top dead center, and said second to (N−1)th fingers being driven to not completely close an inner cavity of said infusion tube when said second to (N−1)th fingers are at the top dead center.

3. The method according to claim 2, wherein a clamping width between said holding means and the bottom dead center of said first and Nth fingers is set smaller than the outer diameter of said infusion tube.

4. The method according to claim 3, further comprising, suppressing pulsation caused by individual driving of said fingers by sequentially and individually driving said fingers from the bottom dead center to the top dead center at a speed proportional to a reciprocal of a tube collapse amount obtained by subtracting the clamping width from the outer diameter of said infusion tube.

5. An infusion pump for pressing an outer surface of an infusion tube to supply a liquid, comprising:

a plurality of independently driven fingers which are arranged along a longitudinal direction of said infusion tube having a predetermined outer diameter, holding means for stationarily holding said infusion tube between said fingers and said holding means, and driving means operatively associated with said fingers to individually move said fingers and control the amount of discharge of the liquid from said infusion tube by pressing said infusion tube from said outer surface through individual movement of said fingers by an amount which eliminates an influence of wall thickness of said infusion tube and such that an amount of discharge of the liquid upon collapsing the infusion tube is proportional to the square of the amount of collapse of the infusion tube.

6. The pump according to claim 5, wherein said fingers comprise first, second, . . . , Nth fingers from an upstream side of a liquid flow, said driving means sequentially and individually drives said first to (N−1)th fingers from a bottom dead center to a top dead center, simultaneously moves said first to (N−1)th fingers toward the bottom dead center, said driving means individually drives said Nth finger from the bottom dead center to a top dead center and drives said Nth finger toward the bottom dead center when the said first finger reaches the top dead center, and said driving means drives said first and Nth fingers to completely close said infusion tube when the first and Nth fingers are at the top dead center, and drives said second to (N−1)th fingers to not comletely close an inner cavity of said infusion tube when the first and Nth fingers are at the dead center.

7. The pump according to claim 6, wherein a clamping width between said holding means and the bottom dead center of said first and Nth fingers is set smaller than the outer diameter of said infusion tube.

8. The pump according to claim 7, wherein, in order to suppress pulsation caused by individual driving of said fingers, a speed for sequentially and individually driving said fingers from the bottom dead center to the top dead centers is set proportional to a reciprocal of a tube collapse amount obtained by subtracting the clamping width from the outer diameter of said infusion tube.

9. The pump according to claim 5, further comprising measuring means for measuring an outer diameter of the infusion tube, controlling means for speed controlling said driving means, by calculating the variation of flow rate of the liquid based on the outer diameter which is measured by the measuring means.

10. An infusion method of pressing an infusion tube from an outer surface thereof to supply a liquid, comprising positioning the infusion tube between a surface and a plurality of independently driven fingers so that the fingers are arranged along a longitudinal direction of said infusion tube, said plurality of fingers including a first finger, a last finger and at least two intermediate fingers between the first and last fingers, said infusion tube having a wall thickness; and individually driving said intermediate fingers to press the intermediate fingers against the outer surface of the infusion tube to supply liquid from the infusion tube in an amount proportional to the square of the amount of collapse of the infusion tube, each of said intermediate fingers being individually driven to move by an amount which eliminates an influence of the wall thickness of said infusion tube.

11. The method according to claim 10, wherein said last finger is driven from a bottom dead center to a top dead center to completely close the infusion tube followed by the first finger being driven from a bottom dead center to a top dead center to completely close the infusion tube, and said intermediate fingers being sequentially driven from a bottom dead center to a top dead center upon the first finger reaching the top dead center.

12. The method according to claim 11, wherein said intermediate fingers do not completely close the infusion tube when the intermediate fingers are at the top dead center.

13. An infusion pump for pressing an outer surface of an infusion tube to supply a liquid, comprising:

a plurality of independently driven fingers adapted to be positioned along a longitudinal direction of the infusion tube, said plurality of fingers including a first finger, a last finger and at least two intermediate fingers between the first and last fingers;

a surface positioned in opposition to the fingers, with the infusion tube being adapted to be located between the surface and the fingers; and driving means operatively associated with said plurality of fingers to individually move each of said plurality of fingers and cause the fingers to press against an outer surface of the infusion tube to discharge liquid from the infusion tube in an amount that is proportional to the square of the amount of collapse of the infusion tube, said driving means individually driving said intermediate fingers in a manner which eliminates an influence of a wall thickness of the infusion tube.

14. The pump according to claim 13, wherein said driving means drives said intermediate fingers between a bottom dead center and a top dead center, and a clamping width between said surface and the intermediate fingers at the bottom dead center being smaller than an outer diameter of the infusion tube.

15. The pump according to claim 13, wherein said driving means includes a motor operatively connected to a cam shaft to rotatably drive the cam shaft and a plurality of cams fixed to the cam shaft, each of said fingers being provided with a collar that is engaged by one of the cams upon rotation of the cam shaft.

16. The pump according to claim 15, wherein each of said fingers includes an elongated slot through which extends the cam shaft.

17. The pump according to claim 15, wherein each of said fingers includes a plurality of elongated holes, and including a plurality of shafts each extending through one of the elongated holes in each finger.

* * * * *

UNITED STATES PATENT AND TRADEMARK OFFICE

CERTIFICATE OF CORRECTION

PATENT NO. : 5,988,983
DATED : November 23, 1999
INVENTOR(S) : Kouichi Furusawa

It is certified that error appears in the above-identified patent and that said Letters Patent is hereby corrected as shown below:

Column 6,
Line 18, delete "10".
Lines 21-32, delete:

" $$\frac{S2}{S1} = \frac{\pi(d+\alpha)^2}{\pi d^2} = \left(1+\frac{\alpha}{d}\right)^2 \cong 1+2\frac{\alpha}{d} \quad (d \gg \alpha) \qquad \ldots(10)$$

$$\frac{S2'}{S1'} = \frac{\pi(d+\alpha)^2 - \pi(\alpha+\Delta d)^2}{\pi(d^2-\Delta d^2)}$$
$$= \frac{d+\Delta d+2\alpha}{d+\Delta d} = 1 + 2\frac{\alpha}{d+\Delta d} \qquad \ldots(11)$$
$$= 1 + 2\frac{\alpha}{d(1+\frac{\Delta d}{d})}$$ "

Lines 21-32, insert:

-- $$\frac{\Delta S2}{\Delta S1} = \frac{\pi(d+\alpha)^2}{\pi d^2} = \left(1+\frac{\alpha}{d}\right)^2 \approx 1+2\frac{\alpha}{d}(d \gg \alpha) \ldots(10)$$

$$\frac{\Delta S2'}{\Delta S1'} = \frac{\pi(d+\alpha)^2 - \pi(\alpha+\Delta d)^2}{\pi(d^2-\Delta d^2)} \qquad \ldots(11)$$
$$= \frac{d+\Delta d+2\alpha}{d+\Delta d} = 1 + 2\frac{\alpha}{d+\Delta d}$$
$$= 1 + 2\frac{\alpha}{d(1+\frac{\Delta d}{d})}$$ --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*